US010006318B2

(12) United States Patent
Sailer et al.

(10) Patent No.: US 10,006,318 B2
(45) Date of Patent: Jun. 26, 2018

(54) COMPONENT OF A VALVE DRIVE OF AN INTERNAL COMBUSTION ENGINE

(71) Applicant: SCHAEFFLER TECHNOLOGIES AG & CO. KG, Herzogenaurach (DE)

(72) Inventors: Peter Sailer, Erlangen (DE); Oliver Schnell, Veitsbronn (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 4 days.

(21) Appl. No.: 15/122,757

(22) PCT Filed: Feb. 26, 2015

(86) PCT No.: PCT/DE2015/200103
§ 371 (c)(1),
(2) Date: Aug. 31, 2016

(87) PCT Pub. No.: WO2015/165445
PCT Pub. Date: Nov. 5, 2015

(65) Prior Publication Data

US 2017/0067374 A1 Mar. 9, 2017

(30) Foreign Application Priority Data

Apr. 29, 2014 (DE) ..... 10 2014 208 005

(51) Int. Cl.
*F01L 1/18* (2006.01)
*F01L 1/24* (2006.01)

(52) U.S. Cl.
CPC ..... *F01L 1/18* (2013.01); *F01L 1/185* (2013.01); *F01L 1/2405* (2013.01); *F01L 2001/187* (2013.01); *F01L 2810/02* (2013.01)

(58) Field of Classification Search
CPC . F01L 1/18; F01L 1/185; F01L 1/2405; F01L 2001/187; F01L 2810/02
See application file for complete search history.

(56) References Cited

U.S. PATENT DOCUMENTS

| | | | |
|---|---|---|---|
| 5,775,280 | A | 7/1998 | Schmidt et al. |
| 7,350,489 | B2 | 4/2008 | Engelhardt et al. |
| 7,350,490 | B2 | 4/2008 | Mock et al. |
| 8,689,754 | B2 | 4/2014 | Christgen et al. |

(Continued)

FOREIGN PATENT DOCUMENTS

| | | |
|---|---|---|
| CN | 102482954 A | 5/2012 |
| CN | 103422924 A | 12/2013 |

(Continued)

OTHER PUBLICATIONS

International Search Report for International Application No. PCT/DE2015/200103 dated May 21, 2015.

*Primary Examiner* — Zelalem Eshete
(74) *Attorney, Agent, or Firm* — Brooks Kushman P.C.

(57) ABSTRACT

A clip for securing a support element to a drag lever in a valve train of an internal combustion engine. The clip includes a first spring limb including an aperture configured to receive a support element of the valve train, a second spring limb including a concave pocket that includes a first bore configured to transmit lubrication oil from a channel of the support element through the second spring limb, and a bracket member connecting the first and second spring limbs.

20 Claims, 1 Drawing Sheet

(56) References Cited

U.S. PATENT DOCUMENTS

| | | | | |
|---|---|---|---|---|
| 8,733,310 | B2 | 5/2014 | Mock et al. | |
| 2013/0306009 | A1* | 11/2013 | Sailer | F01L 1/34 123/90.15 |

FOREIGN PATENT DOCUMENTS

| | | | |
|---|---|---|---|
| DE | 19615088 | A1 | 10/1997 |
| DE | 19617523 | A1 | 11/1997 |
| DE | 19624413 | A1 | 1/1998 |
| DE | 19640919 | A1 | 4/1998 |
| DE | 20000746 | U1 | 5/2000 |
| DE | 102004041231 | A1 | 3/2006 |
| DE | 102007008409 | A1 | 8/2008 |
| DE | 102011077024 | A1 | 12/2012 |
| EP | 1554470 | B1 | 3/2008 |
| JP | 2002155710 | A | 5/2002 |

* cited by examiner

COMPONENT OF A VALVE DRIVE OF AN INTERNAL COMBUSTION ENGINE

CROSS-REFERENCE TO RELATED APPLICATIONS

This application is the U.S. National Phase of PCT Appln. No. PCT/DE2015/200103 filed Feb. 26, 2015, which claims priority to DE 10 2014 208 005.3 filed Mar. 29, 2014, the entire disclosures of which are incorporated by reference herein.

TECHNICAL FIELD

The disclosure relates to a component of a valve drive of an internal combustion engine, with a drag lever, a support element and a connection clip connected to the drag lever in the central region a cam thrust surface. On its lower face at a first end an equipment for a gas exchange valve, and at a second end has a concave indentation, over which it is fixed in an articulated manner by a connection clip, which is formed by two spring limbs connected to each other at one end by a transverse bracket, to a head of the support element, wherein a spring limb is in contact with the lower face of the drag lever and envelops with a recess a retaining region of the support element underneath its head, and another spring limb extends on the upper face of the drag lever and wherein through the indentation extends a channel supplied by the support element for injection oil lubrication.

BACKGROUND

Components equipped with connection clips are known from prior art (see DE 10 2004 041 231 A1, EP 1554 470 B1, DE 10 2011 077 024 A1 (drag lever with connection clip for support element), EP 1 554 470 B1). The other, upper spring limb of the connection clip is usually designed open, the channel for injection oil lubrication in the dome-shaped molding of the drag lever is directed in the longitudinal direction of the drag lever to its first end and is used for oil lubrication of the cam contact on the bracketed drag lever. Direct or indirect injection oil admission for lubrication or cooling of other components located in the cylinder head is not provided.

At the same time, a permanent tightness of the connection clip is problematic.

SUMMARY

It may be beneficial to provide a component without the above disadvantages.

Such benefits may be accomplished by locating a spring limb of the connection clip, at least largely closed, on the upper face of the drag lever above the dome-shaped indentation that may include an injection oil bore in fluid communication with the channel, wherein the bore extends along the drag lever over its second end.

The spring limb of the connection clip may be provided with two injection oil bores, one of which extends away from the drag lever and the other extends in the drag lever direction and thus towards the rising cam.

Thus, a primary admission of lubricating and cooling oil emanating from the component to other parts not belonging to the component is proposed, which may include bearings. This also makes it possible to splash oil on a lower face of the cylinder head or baffle plates to produce oil mist.

The injection oil bores can be simply punched into the connection clip. A special and more elaborate fitting-out of the head of the support elements may be unnecessary. It may require only a simple axial channel with an optional protuberance.

Due to the closed envelopment of the upper face of the drag lever in the hemispherical head above the upper spring limb, the connection clip has an excellent fit and can well absorb laterally introduced forces.

The drag lever may include a U profile in cross section and is made of thin-walled steel sheet, with its hemispherical head in the lower face thus appears as a material depression in the upper face. If necessary, with e.g. an appropriately thick transom in the hemispherical head region, the upper face can also be flat.

Another embodiment may relate to a position of injection oil bores. The one injection oil bore may be introduced on a side of the hemispherical head facing the second end and the additional injection oil bore may be on the side of the hemispherical head facing the first end.

Another embodiment may include an "oblique" position of at least one of the injection oil bores so that the oil spray jet is conducted on the side of the support element or cam contact past the drag lever. If necessary, a "widespread" oil spray jet is also possible.

The connection clip is "conducted" from the second end of the drag lever. However, if the drag lever is recessed in the central region, the connection clip can also be mounted from the side of the recess over the drag lever, or at least have in this section yet another retaining bracket or the like.

An exemplary embodiment, discloses using a connection clip a standard mass items US fold-back clip (multipurpose clip) as it is sold e.g. by Jakob Maul GmbH (Bad Konig, Germany) under the name of "mauly". After mounting the fold-back clip on the drag lever, its handles are expediently removed. It is clear that also a clip can be used, which is only similar to the design of the US fold-back clip.

BRIEF DESCRIPTION OF THE DRAWINGS

The invention is apparent from the drawing.

DETAILED DESCRIPTION

Figure 1:
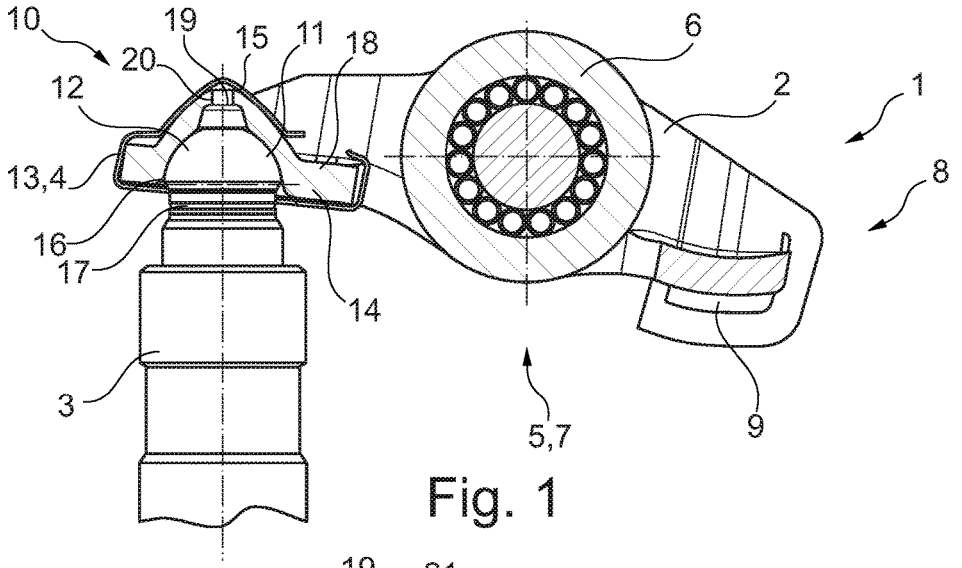
FIG. 1 shows a longitudinal section of a valve train component.

FIG. 1 discloses a diagram 1 of a valve drive of an internal combustion engine. The diagram 1 consists of a drag lever 2 made of thin steel sheet, a support element 3 and a connection clip 4 made of spring steel.

The drag lever 2 is formed in a U-shape in cross-section. It has in its middle section a recess 25 with a cam thrust surface 6 designed as a roller. On its lower face 7 at a first end 8, the drag lever 2 has a surface 9 for a gas exchange valve and on the second end 10 a dome-shaped indentation 11.

Figure 2:
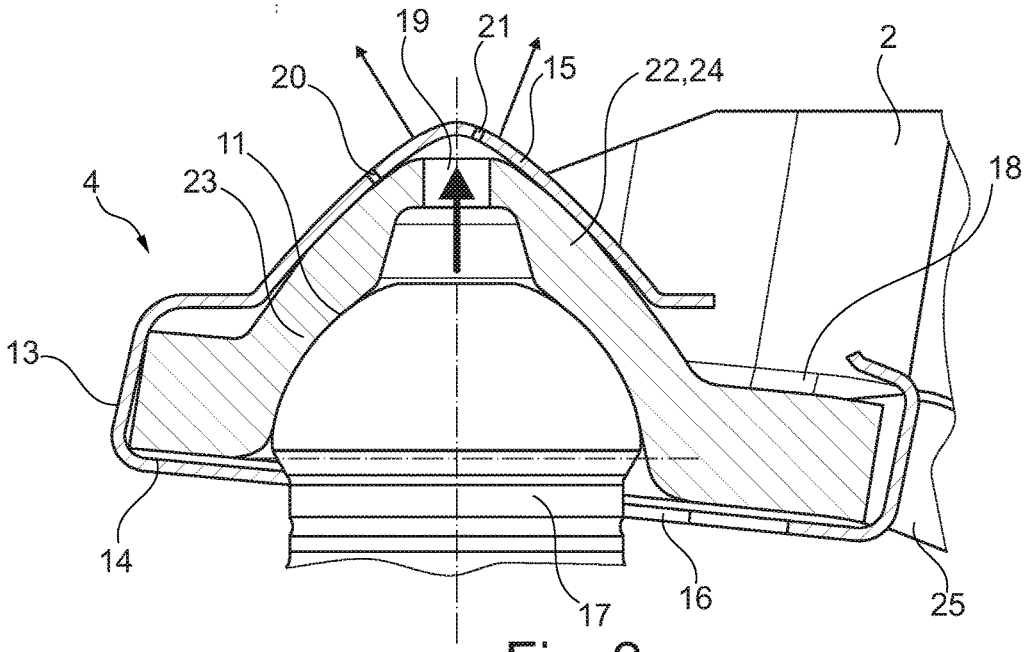
FIG. 2 shows a partial longitudinal section of the valve train component in the section of the support element and FIGS. 3, 4 show spatial views of the connection clip with two injection oil bores.

As can be seen in FIGS. 1 and 2, a head 12 of the support element 3 sits in the latter indentation 11. The drag lever 2 may be fixed in an articulated and captive manner to the connection clip 4 on the head 12 of the support element 3.

Figure 3:
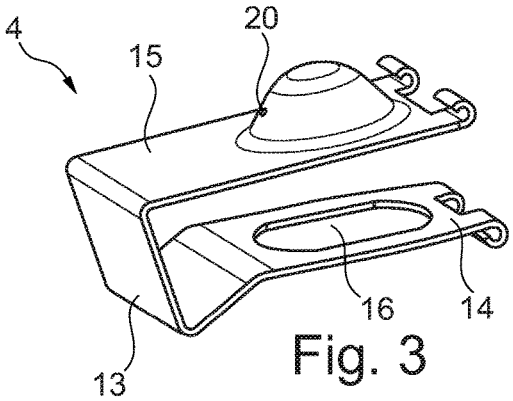
Figure 4:
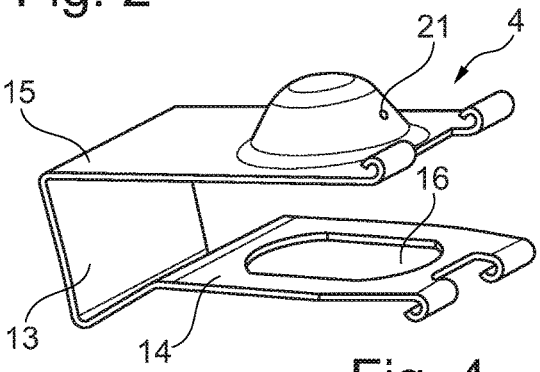

The connection clip 4 is carried out in the design of a US fold-back clip. It includes as described in detail in FIGS. 3 and 4, two spring limbs 14, 15 connected by a transverse bracket 13. A spring limb 14 may lay on the lower face 7 of the drag lever 2 and engages with a recess 16 in a retaining region 17 of the support element 3 below its head 13 (see FIG. 1, 2). The other spring limb 15 extends on an upper face 18 of the drag lever 2. As can be seen, in this case it largely clings to material depression 22 produced by the concave indentation 11 on the upper face 18. The aforementioned transverse bracket 13 maybe seated on the second end 10 of the drag lever 2.

Through the indentation 11 extends a channel 19 along the axial line of the support element 3 for injection oil lubrication. The channel is in fluid communication with two injection oil bores 20, 21 in the other spring limb 15 of the connection clip 4.

The injection oil bore 20 (right) is located in the region of a first quadrant 23 of the indentation 11 facing the end 8. It is used for the admission of spray oil to a cam contact section on the cam thrust surface 6. In this embodiment, the injection oil bore 20 may be aligned so that a contact gap between the cam and its cam surface 6 is not necessarily impinged.

The injection oil bore 21 (left) is located in the region of a second quadrant 24 of the indentation 11 facing the other end 10. It may be used for spraying oil at lubrication points in a cylinder head area, which may also include bearings.

REFERENCE SYMBOLS

1 Component
2 Drag lever
3 Support element
4 Connection clip
5 Middle region
6 Cam thrust surface
7 Lower face
8 First end
9 Surface
10 Second end
11 Indentation
12 Head
13 Transverse bracket
14 Spring limb
15 Spring limb
16 Recess
17 Retaining region
18 Upper face
19 Channel
20 Injection oil bore
21 Further injection oil bores
22 Material depression
23 Quadrant
24 Quadrant
25 Recess

The invention claimed is:

1. A valve drive of an internal combustion engine comprising:

a drag lever having a first end with a lower face including a surface for an exchange valve, a second end including a dome-shaped indentation, and a middle section including a cam thrust surface;

a support element including a channel for injection of oil lubrication and extending through the dome-shaped indentation; and a connection clip configured to fix the drag lever in an articulated manner, wherein the connection clip includes a first and second spring limb connected to each other by a transverse bracket, wherein the first spring limb is in contact with the lower face of the drag lever and includes a recess configured to surround a retaining region underneath a head of the support element, and the second spring limb extends on an upper face of the drag lever and lies on the upper face of the drag lever generally following a contour of the dome-shaped indentation, and includes a first injection oil bore that is in fluid connection with the channel and directed over the second end of the drag lever.

2. The valve drive of an internal combustion engine of claim 1, wherein the second spring limb of the connection clip includes a second injection oil bore in fluid communication with the channel and is located over the drag lever at the first end.

3. The valve drive of an internal combustion engine of claim 2, wherein the dome-shaped indentation forms around an upper face of the drag lever as a hemisphere-like material depression, and clings the second spring limb of the connection clip.

4. The valve drive of an internal combustion engine of claim 3, wherein the first injection oil bore lies in a first quadrant facing the second end, and the second injection oil bore lies in a second quadrant facing the first end of the drag lever.

5. The valve drive of an internal combustion engine of claim 1, wherein the channel aligns along an axial line of the support element.

6. The valve drive of an internal combustion engine of claim 1, wherein the transverse bracket of the connection clip is located next to a recess of the middle section of the drag lever at the second end.

7. The valve drive of an internal combustion engine of claim 6, wherein the connection clip is a US fold-back clip.

8. The valve drive of an internal combustion engine of claim 1, wherein the first injection oil bore is located transversely to the drag lever in such a manner that an extended axial line of the first injection oil bore does not intersect an extension of an axial line of the support element.

9. A clip for securing a support element to a drag lever in a valve train of an internal combustion engine, the clip comprising:

a first spring limb including an aperture configured to receive a support element of the valve train;

a second spring limb including a concave pocket that includes a first bore configured to transmit lubrication oil from a channel of the support element through the second spring limb; and a bracket member connecting the first and second spring limbs.

10. The clip of claim 9, wherein the concave pocket is aligned with the aperture to define a space there between for receiving an end of the support element.

11. The clip of claim 9, wherein the concave pocket is configured to form around an upper surface of the drag lever.

12. The clip of claim 9, wherein the first bore is smaller than the concave pocket.

13. The clip of claim 12, wherein the concave pocket includes a second bore configured to transmit lubrication oil received from a channel of the support element.

14. The clip of claim 9, wherein the first bore is adjacent an outer surface of the drag lever when the clip is connected to the drag lever.

15. The clip of claim 9, wherein the concave pocket is above an outlet of the support element and the first spring limb when the clip is connected to the drag lever.

16. The clip of claim 15, wherein the concave pocket includes an apex that is spaced from the outlet.

17. The clip of claim 16, wherein the concave pocket further includes a second bore configured to transmit lubrication oil received from the outlet, and wherein the second bore is aligned with the outlet and offset from the apex.

18. A clip for securing a support element to a drag lever in a valve train of an internal combustion engine, the clip comprising:

a first spring limb including an aperture configured to receive the valve train;

a second spring limb including a concave pocket that includes a bore configured to transmit lubrication oil from a channel of the support element through the second spring limb, wherein the bore is located above a planar surface of the second spring limb and is smaller than the channel of the support element; and a bracket member connecting the first and second spring limbs.

19. The clip of claim 18, wherein the bore is located above a planar surface of the second spring limb.

20. The clip of claim 19, wherein the second spring limb and the concave pocket are formed from the planar surface.

* * * * *